US010220274B2

(12) United States Patent
Woodall

(10) Patent No.: US 10,220,274 B2
(45) Date of Patent: Mar. 5, 2019

(54) GOLF TEE SETTING DEVICE

(71) Applicant: Stephanie Woodall, Myrtle Beach, SC (US)

(72) Inventor: Stephanie Woodall, Myrtle Beach, SC (US)

( * ) Notice: Subject to any disclaimer, the term of this patent is extended or adjusted under 35 U.S.C. 154(b) by 72 days.

(21) Appl. No.: 15/224,282

(22) Filed: Jul. 29, 2016

(65) Prior Publication Data

US 2017/0028279 A1 Feb. 2, 2017

Related U.S. Application Data

(60) Provisional application No. 62/198,578, filed on Jul. 29, 2015.

(51) Int. Cl.
*A63B 57/20* (2015.01)
*A63B 57/00* (2015.01)

(52) U.S. Cl.
CPC ..... *A63B 57/0037* (2013.01)

(58) Field of Classification Search
CPC ..... A63B 57/0037; A63B 57/0032; Y10T 403/342
USPC ..... 473/386; D21/793
See application file for complete search history.

(56) References Cited

U.S. PATENT DOCUMENTS 3,658,331 A * 4/1972 Driscoll ..... A63B 57/0037 473/386
D302,714 S * 8/1989 Chatham ..... D21/793
4,982,510 A * 1/1991 Musillo ..... A63B 57/0037 33/833
D344,779 S * 3/1994 Axne ..... D21/793
5,634,862 A * 6/1997 Gamache ..... A63B 57/0037 473/386
5,735,758 A * 4/1998 Miketinac ..... A63B 57/0037 473/386
5,913,737 A * 6/1999 Park ..... A63B 57/0037 473/386
D468,385 S * 1/2003 Fleischmann ..... D21/793
D473,279 S * 4/2003 Fleischmann ..... D21/789
6,932,722 B2 * 8/2005 Wood ..... A63B 57/0037 224/918
7,223,184 B2 * 5/2007 Suwito ..... A63B 57/0037 473/386
7,699,721 B2 * 4/2010 Godlove, II ..... A63B 57/0037 473/386
D678,045 S * 3/2013 Paolini ..... D8/382
2008/0039237 A1 * 2/2008 Osterberg ..... A63B 57/0037 473/386

(Continued)

*Primary Examiner* — Joshua T Kennedy
(74) *Attorney, Agent, or Firm* — Incorporating Innovation LLC; Charlena Thorpe, Esq.

(57) ABSTRACT

A golf tee setting device comprising a top side, a bottom side, a first lateral side, and a second lateral side is provided. At least a portion of the top side is stair-stepped having two or more flat surfaces at different heights wherein one or more of the flat surfaces includes an opening extending through the tee setting device to the bottom side and configured such that a stem and a head of a golf tee may pass through each openings. At least a portion of the first lateral side of the tee setting device is stair-stepped having two or more flat surfaces at different heights wherein one or more of the flat surfaces includes an opening extending through the tee setting device to the second lateral side and configured such that a stem and a head of a golf tee may pass through each openings.

12 Claims, 3 Drawing Sheets

(56) References Cited

U.S. PATENT DOCUMENTS

2009/0175678 A1* 7/2009 Nientiedt ..... H02B 1/01
403/171

* cited by examiner

GOLF TEE SETTING DEVICE

TECHNICAL FIELD

This disclosure relates to implementations of a golf tee setting device.

BACKGROUND

Placing a golf tee at the same distance in the ground may yield different results in a golf swing depending, for example, on the height of the green. That is, the distance from the top of the green to the bottom of the ball can vary even though the tee is in the same distance in the ground. This distance may affect the launch angle of a golf ball on the golf tee when struck by a club. Therefore, it may be desirable to place the top of the golf tee at a consistent height relative to the green and/or to be able to adjust tee heights based on the golf shot being taken. There does not exist any mechanism to achieve this result.

DETAILED DESCRIPTION

Figure 1A:
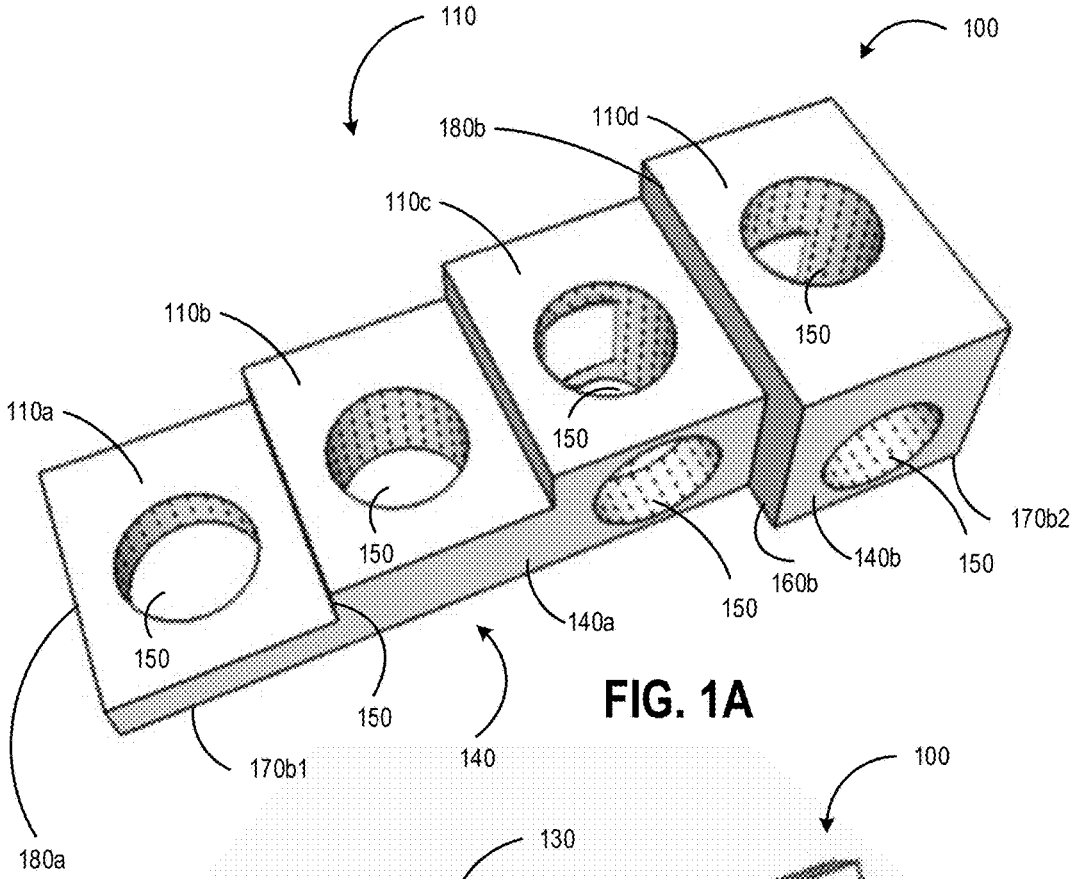
FIG. 1A illustrates a perspective view of the top and right side of an implementation of example tee setting device according to the principles of the present disclosure.

Implementations if a golf tee setting device are provided. In some implementations, the golf tee setting device may be used to set the height of a golf tee. In some implementations, the golf tee setting device may be used to set the height of the golf tee relative to the top of the green (e.g., grass).

In some implementations, a tee setting device comprises a top side, a bottom side, a first lateral side, and a second lateral side. In some implementations, at least a portion of the top side is stair-stepped having two or more flat surfaces at different heights wherein one or more of the flat surfaces includes an opening extending through the tee setting device to the opposite side and configured such that a stem and a head of a golf tee may pass through each openings. In some implementations, at least a portion of the first lateral side of the tee setting device is stair-stepped having two or more flat surfaces at different heights wherein one or more of the flat surfaces includes an opening extending through the tee setting device to the opposite side and configured such that a stem and a head of a golf tee may pass through each openings.

FIGS. 1A-1D illustrates an implementation of an example tee setting device 100 according to the principles of the present disclosure.

As shown in FIGS. 1A-1D, in some implementations, the tee setting device 100 comprises a first side 110 (e.g., top side), second side 120 (e.g., bottom side), third side 130 (e.g., left side), and a forth side 140 (e.g., right side).

In some implementations, at least a portion of at least one side of the tee setting device 100 is stair-stepped. In some implementations, more than one side of the tee setting device 100 is stair-stepped. In some implementations, a stair-stepped side of the tee setting device 100 has two or more flat surfaces at different heights. For example, as shown in FIG. 1A, the top side 110 of the tee setting device 100 is stair-stepped having four flat surfaces 110*a*, 110*b*, 110*c*, and 110*d* at different heights and a portion of the right side 140 is stair-stepped having two flat surfaces 140*a* and 140*b* at different heights.

In some implementations, the rise between flat surfaces of a stair-stepped side of the tee setting device 100 may be constant. For example, referring to FIG. 1C, in some implementations, the rise 160*a* between flat surfaces 110*a* and 110*b*, 110*b* and 110*c*, and 110*c* and 110*d* of the top side 110 may be the same. In some implementations, the rise between flat surfaces may vary. In some implementations, the rise between flat surfaces of a stair-stepped side may be 0.25 inches. In some implementations, the rise between flat surfaces may be greater than or less than 0.25 inches.

In some implementations, the rise between flat surfaces of a first stair-stepped side may be the same as the rise between flat surfaces of a second stair-stepped side. For example, the rise 160*a* between flat surfaces of the top side 110 may be the same as the rise 160*b* (see FIG. 1A) between flat surfaces 140*a*, 140*b* of the right side 140. In some implementations, the rise between flat surfaces of a first stair-stepped side may be different from the rise between flat surfaces of a second stair-stepped side.

In some implementations, the run of each flat surface of a stair-stepped side of the tee setting device 100 may be the same. For example, referring to FIG. 1C, in some implementations, the run 170*a* of each flat surface 110*a*, 110*b*, 110*c*, and 110*d* of the top side 110 may be the same. In some implementations, the run of each flat surface may vary. For example, referring to FIG. 1A, the run 170*b*1 of flat surface 140*a* is different than the run 170*b*2 of flat surface 140*b*. In some implementations, the run of a flat surface of a stair-stepped side may be 1.25 inches. In some implementations, the run of a flat surface may be greater than or less than 1.25 inches.

In some implementations, the run of each flat surface of a first stair-stepped side may be the same as the run of each flat surface of a second stair-stepped side. In some implementations, the run of each flat surface of a first stair-stepped side may be different from run of each flat surface of a second stair-stepped side. For example, the run 170*a* of each flat surface of the top side 110 may be different than the run 170*b*1 (see FIG. 1A) of flat surface 140*a* of the right side 140.

In some implementations, to achieve a first stair-stepped side and a second stair-stepped side, the width of the flat surfaces of the first stair-stepped side vary to achieve the rise between flat surfaces of the second stair-stepped side. For example, referring to FIG. 1A, to achieve a first stair-stepped side (e.g., top side 110) and a second stair-stepped side (e.g., right side 140), the width 180*b* of the flat surface 110*d* of the top side 110 is greater than the width 180*a* of the flat surfaces 110*a, b*, and *c* of the top side 110 to achieve the rise 170*b*2 between flat surfaces 140*a* and 140*b* of the right side 140. In some implementations, the width 180*a* of the flat surfaces 110*a, b*, and *c* of the top side 110 may be 1.25 inches. In some implementations, the width 180*a* of the flat surfaces 110*a, b*, and *c* of the top side 110 may be greater than or less than 1.25 inches. In some implementations, the width 180*b* of the flat surface 110*d* of the top side 110 may be 1.5 inches.

In some implementations, the width 180*b* of the flat surface 110*d* of the top side 110 may be greater than or less than 1.5 inches.

In some implementations, at least one side of the tee setting device 100 is flat. In some implementations, more than one side of the tee setting device 100 is flat. For example, as shown in FIG. 1B, the bottom side 120 and the left side 130 of the tee setting device 100 are flat.

In some implementations, a stair-stepped side is opposite a flat side. For example, the stair-stepped top side 110 is opposite the flat, bottom side 120 and the stair-stepped right side 140 is opposite the flat, left side 130.

Figure 1B:
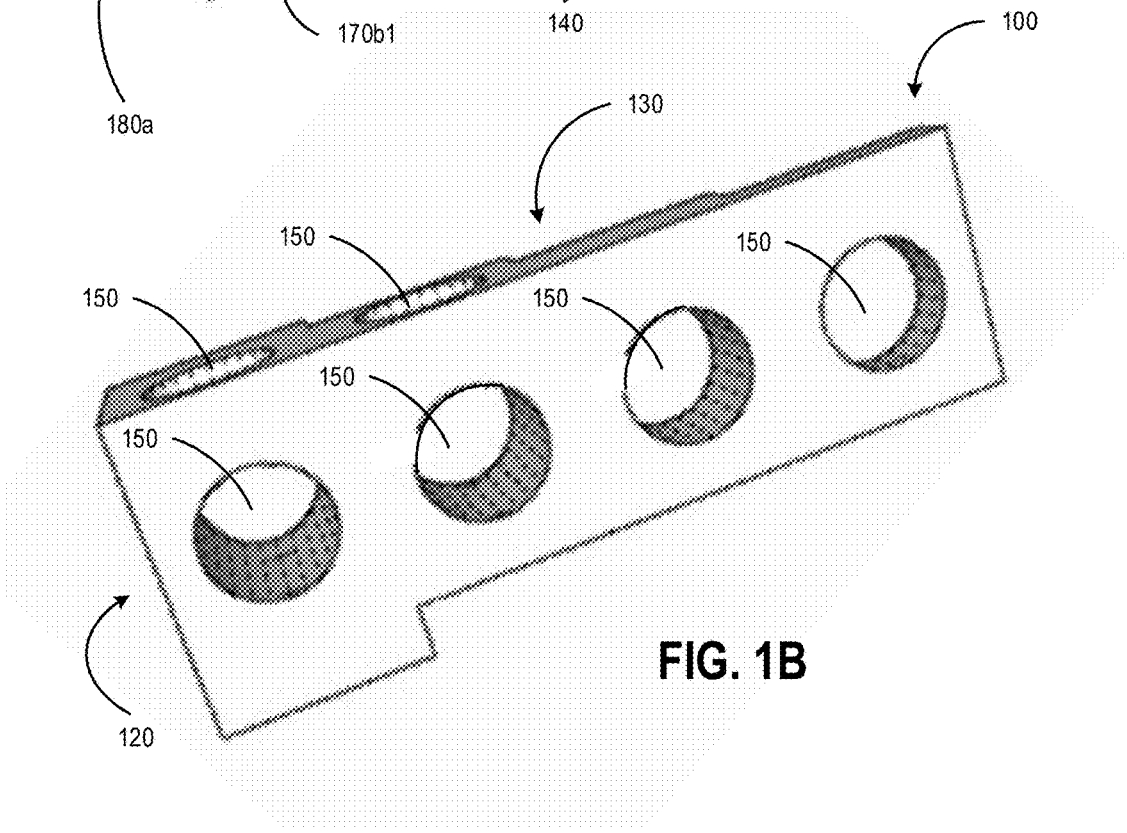
FIG. 1B illustrates a perspective view of the bottom and left side of the tee setting device of FIG. 1A.
Figure 1C:
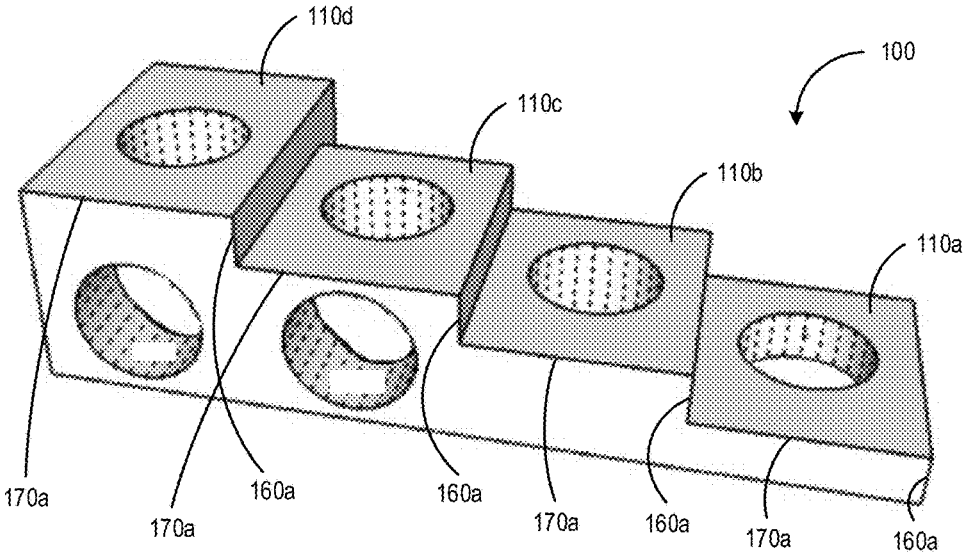
FIG. 1C illustrates a perspective view of the top and left side of the tee setting device of FIG. 1A.
Figure 1D:
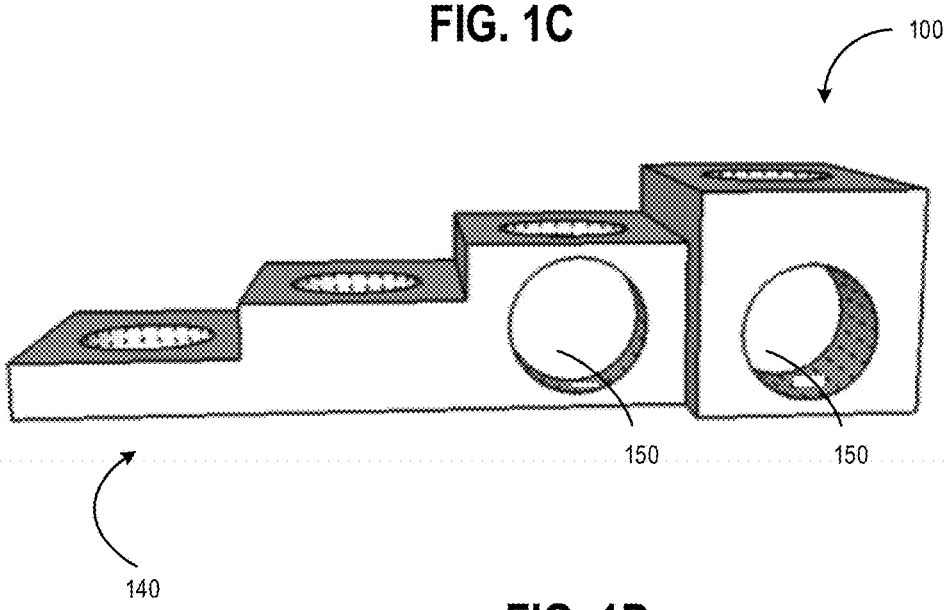
FIG. 1D illustrates another perspective view of the top and right side of the tee setting device of FIG. 1A.

As shown in FIGS. 1A and 1B, in some implementations, a stair-stepped side of the tee setting device 100 may include an opening 150 at each elevation, where each opening 150 extends through the tee setting device 100 to the opposite side. For example, in some implementations, the top side 110 may include an opening 150 at each elevation where each opening 150 extends through the tee setting device 100 to the bottom side 120. Furthermore, referring to FIG. 1D, in some implementations, the right side 140 may include an opening 150 at each elevation where each opening 150 extends through the tee setting device 100 to the left side 130.

Figure 3:
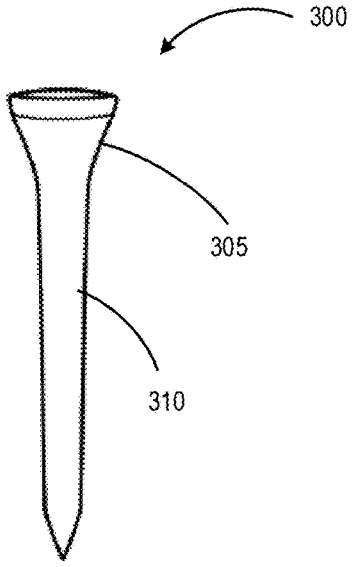
FIG. 3 PRIOR ART
FIG. 3 illustrates an example golf tee.

FIG. 3 illustrates an example golf tee 300 having a stem 310 and a head 305. In some implementations, the openings 150 of the tee setting device 100 are configured so that the stem 310 and head 305 of the golf tee 300 may pass through the openings 150. In some implementations, the openings 150 may be cylindrical. In some implementations, the openings 150 may be any suitable shape that allows a golf tee to pass through the opening.

To use the tee setting device 100 to set a golf tee into a green, a flat, first side (e.g., the bottom side 120) of the tee setting device 100 may be placed on the green. With a stair-stepped, second side facing upward (e.g., the top side 110), a golf tee may be inserted into one of the openings extending from the first side to the second side of the tee setting device 100 and pressed into the green until the top 307 of the golf tee is aligned with the surface about the opening. In some implementations, the side (e.g., top side 110 or right side 140) and the opening on the side into which the user places the golf tee is selected based upon how far above the green the user wants the top of the golf tee, and hence the golf ball, to rest.

Once the golf tee is pressed into the green until the top 307 of the golf tee is aligned with the surface about the opening, the tee setting device 100 is lifted up over the golf tee and removed leaving the golf tee in place.

Figure 2:
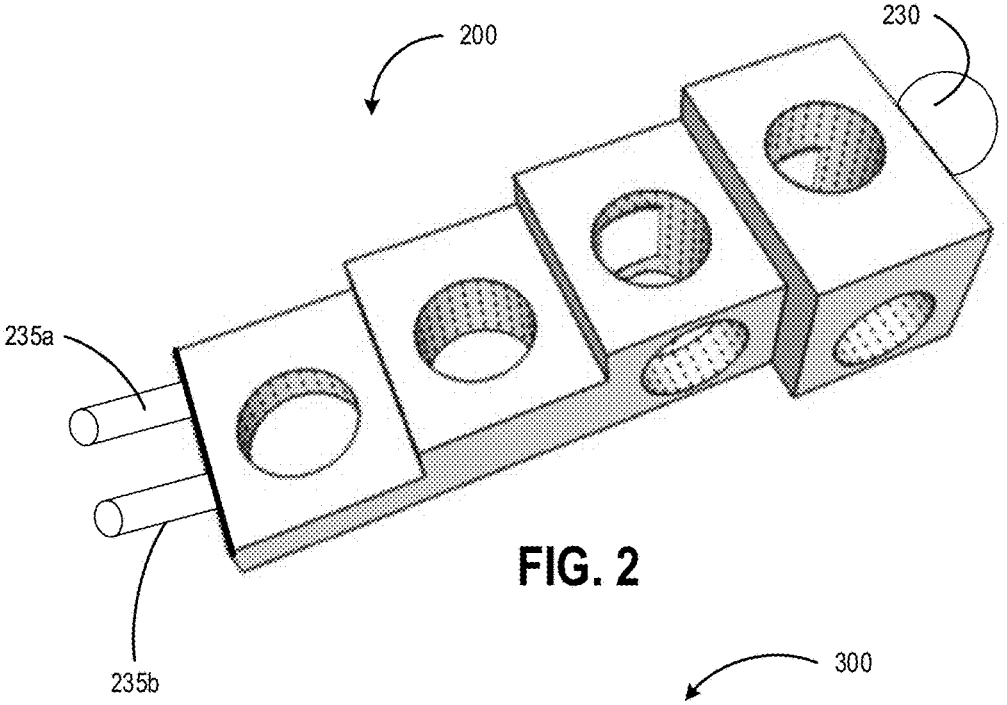
FIG. 2 illustrates another implementation of an example tee setting device according to the principles of the present disclosure.

FIG. 2 illustrates another implementation of an example tee setting device 200 according to the principles of the present disclosure. In some implementations, the tee setting device 200 is similar to the tee setting device 100 but further comprises an attachment device 230 and a first post 235*a* and a second post 235*b* (collectively posts 235).

In some implementations, the attachment device 230 may be configured to attach the tee setting device 200 to a belt, bag, and/or other suitable object. In this way, the tee setting device 200 may be kept close at hand.

In some implementations, the attachment device 230 may extend from a first end of the tee setting device 200. In some implementations, the attachment device 230 may extend from any suitable location on tee setting device 200 that does not inhibit its function. In some implementations, the attachment device 230 may have an opening extending therethrough. In some implementations, the opening of the attachment device 230 may be configured to receive a loop of material and/or other device (e.g., a key ring) therethrough.

In some implementations, not shown, the attachment device 230 may be replaced with an eye bolt having an opening.

In some implementations, the first post 235*a* and the second post 235*b* may extend from a second end that is opposite the first end of the tee setting device 200. In some implementations, the posts 235 may extend from any suitable location on the body portion 205. In some implementations, the first post 235*a* and the second posts 235*b* extend from the body portion 205 parallel to one another. In some implementations, each of the posts 235 may have a cylindrical shape. In some implementations, each of the posts 235 may have any shape suitable for use as part of a golf ball divot repair tool. In some implementations, each post 235*a, b* may be threadedly secured to the tee setting device 200. In some implementations, the posts 235 may be integrally formed as part of the tee setting device 200. In some implantations, the posts 235 may be secured to the tee setting device 200 through any method currently known or future developed.

In some implementations, the posts 235 may allow the tee setting device 200 to be used in the same or similar manner as a golf ball divot repair tool.

In some implementations, the tee setting device 100, 200 may be manufactured from a polymer. In some implementations, the tee setting device 100, 200 may be manufactured from a metal (e.g., aluminum, titanium, steel and/or an alloy thereof. In some implementations, the tee setting device 100, 200 may be manufactured from any suitable device.

Reference throughout this specification to "an embodiment" or "implementation" or words of similar import means that a particular described feature, structure, or characteristic is included in at least one embodiment of the present invention. Thus, the phrase "in some implementations" or a phrase of similar import in various places throughout this specification does not necessarily refer to the same embodiment.

Many modifications and other embodiments of the inventions set forth herein will come to mind to one skilled in the art to which these inventions pertain having the benefit of the teachings presented in the foregoing descriptions and the associated drawings.

The described features, structures, or characteristics may be combined in any suitable manner in one or more embodiments. In the above description, numerous specific details are provided for a thorough understanding of embodiments of the invention. One skilled in the relevant art will recognize, however, that embodiments of the invention can be practiced without one or more of the specific details, or with other methods, components, materials, etc. In other instances, well-known structures, materials, or operations may not be shown or described in detail.

While operations are depicted in the drawings in a particular order, this should not be understood as requiring that such operations be performed in the particular order shown or in sequential order, or that all illustrated operations be performed, to achieve desirable results.

The invention claimed is:

1. A tee setting device comprising:

a top side;

a bottom side opposite the top side;

a first lateral side; and a second lateral side opposite the first lateral side, wherein at least a portion of the top side of the tee setting device is stair-stepped having two or more flat surfaces at different heights wherein one or more of the flat surfaces includes an opening extending through the tee setting device to the bottom side and configured such that a stem and a head of a golf tee may pass through each opening;

at least a portion of the first lateral side of the tee setting device is stair-stepped having two or more flat surfaces at different heights wherein one or more of the flat surfaces includes an opening extending through the tee setting device to the second lateral side and configured such that a stem and a head of a golf tee may pass through each openings;

the bottom side and second lateral side are flat; and wherein each of the openings has a different length.

2. The tee setting device of claim 1 wherein the rise between flat surfaces of the top side is constant.

3. The tee setting device of claim 1 wherein the rise between flat surfaces of the first lateral side are constant.

4. The tee setting device of claim 1 wherein a rise between flat surfaces of the top side varies.

5. The tee setting device of claim 1 wherein a rise between flat surfaces of the first lateral side varies.

6. The tee setting device of claim 1 wherein a run of each flat surface of the top side is constant.

7. The tee setting device of claim 1 wherein a run of each flat surface of the first lateral side is constant.

8. The tee setting device of claim 1 wherein a run of each flat surface of the top side varies.

9. The tee setting device of claim 1 wherein a run of each flat surface of the first lateral side varies.

10. The tee setting device of claim 1 wherein a width of one or more of the flat surfaces of the top side vary.

11. The tee setting device of claim 1 further comprising a pair of elongated cylindrical-shaped posts extending parallel to each other wherein the pair of elongated cylindrical-shaped posts extends from an end of the tee seeing device.

12. A method of using the tee setting device of claim 1, the method comprising:

placing a flat, first side of the tee setting device on a green;

with a stair-stepped, second side facing upward, inserting a golf tee into one of the openings extending from the first side to the second side and pressing the golf tee into the green until the top of the golf tee is aligned with the surface of the second side about the opening; and lifting the tee setting device up over the golf tee thereby leaving the golf tee in place.

* * * * *